US005255537A

United States Patent [19]

Schimko

[11] Patent Number: 5,255,537

[45] Date of Patent: Oct. 26, 1993

[54] FLAT-BED KNITTING MACHINE

[76] Inventor: Reinhold Schimko, c/o Universal Maschinenfabrik Dr. Rudolf Schieber GmbH & Co. KG, Postfach 20 D-7084 Westhausen, Fed. Rep. of Germany

[21] Appl. No.: 681,508

[22] PCT Filed: Sep. 28, 1989

[86] PCT No.: PCT/EP89/01141

§ 371 Date: Apr. 26, 1991

§ 102(e) Date: Apr. 26, 1991

[87] PCT Pub. No.: WO90/04669

PCT Pub. Date: May 3, 1990

[30] Foreign Application Priority Data

Oct. 28, 1988 [DE] Fed. Rep. of Germany ..... 3836806

[51] Int. Cl.[5] ..... D04B 14/70; D04B 15/36

[52] U.S. Cl. ..... 66/75.1; 66/78; 66/123

[58] Field of Search ..... 66/75.1, 75.2, 123, 66/215, 216, 217, 222, 223, 78

[56] References Cited

U.S. PATENT DOCUMENTS

| | | | |
|---|---|---|---|
| 3,892,108 | 7/1975 | Hadam | 66/123 |
| 4,100,767 | 7/1978 | Schieber et al. | 66/75.2 |
| 4,287,727 | 9/1981 | Otoshi | 66/75.2 |
| 4,409,801 | 10/1983 | Shima | 66/75.1 |
| 4,414,806 | 11/1983 | Schimko | 66/75.2 |
| 4,481,793 | 11/1984 | Cuche et al. | 66/75.2 |
| 4,490,995 | 1/1985 | Essig | 66/75.2 |
| 4,615,187 | 10/1986 | Schimko | 66/75.2 |
| 4,662,192 | 5/1987 | Schimko | 66/75.1 |
| 4,667,488 | 5/1987 | Stoppazzini | 66/75.1 |

FOREIGN PATENT DOCUMENTS

| | | | |
|---|---|---|---|
| 2656824 | 6/1978 | Fed. Rep. of Germany | 66/75.1 |
| 2177427A | 1/1987 | United Kingdom . | |

*Primary Examiner*—Clifford D. Crowder
*Assistant Examiner*—Larry D. Worrell, Jr.
*Attorney, Agent, or Firm*—Limbach & Limbach

[57] ABSTRACT

A flat-bed knitting machine has sprung shank needles (N) arranged one behind the other in the needle channels of the needle beds with first and second needle ends (1, 2) and sliding lifting plates (H) with an operative end (3) and a hinge system with at least four sliding needle lowering devices (N2.1, N2.2) in the hinge region. In order to improve and simplify the construction and operation of the needle beds and hinge systems for the whole range of bonding technology, the lifting plates (H) are designed to raise the second needle ends (2) in two stages to half and full height, the hinge system has control tongue (S1) which can be swung in the hinge plane by the first needle ends (1) in the hinge system and at least one first group of hinge components (A1.1, A1.2, A2.1, A2.1) which can be engaged and disengaged perpendicularly to the hinge plane.

14 Claims, 10 Drawing Sheets

S
Position
Position
1
2
3
4
5
6
7
8
9
10
11
12
13
14
15
16
17
18
19
20
21
22
23
24
S1
F3
F5
F6
F7
F10
N2.1
N2.2
N2.3
N2.4
F8
F2
F4
F9
C3.1
C3.2

FLAT-BED KNITTING MACHINE

BACKGROUND OF THE INVENTION

The invention relates to a flat-bed knitting machine comprising flexible shank needles arranged in the needle channels of the needle bed, each said needle having an anterior first needle butt always projecting from the needle bed and a posterior second needle butt which sinks into the needle bed under the resilience of its own flexible shank, displacing jacks (pushers) located behind the flexible shank needles, each said jack having an operating butt and a forward end which is displaceable under the flexible shaft of the flexible shank needle for selectively lifting the second needle butt, jacquard jacks located behind and slideable on the displacing jacks and a cam system arranged symmetrically about its central longitudinal axis for selecting and operating the needles and jacks and which, in the region of the second needle butts, has at least two needle sinkers displaceable in the cam plane.

Such a flat-bed knitting machine is known for example from DE 35 23 989 C1. In this patent the displacing jacks are formed as arresting or locking jacks which allow the second needle butts to be selectively lifted into a working position for engaging with cams of the cam-system. This known flat-bed knitting machine enables the needle channels to be milled without interruption, i.e., at a single pass with a constant milling-depth, without affecting the machine's full knitting capabilities including those of transferring stitches and loops, possibly of different withdrawal depths i.e. sizes, in the same row.

SUMMARY OF THE INVENTION

It is an object of the present invention to provide a flat-bed knitting machine of the type described above with an improved and simplified cam- and knitting-system wherein the number of non-fixed cams of the cam system and the means required to control them are reduced while retaining the machine's simplicity of construction and manufacture.

This is achieved in accordance with the invention, in that a) the displacing jack is formed as a purely displaceable lifting jack having a two-stepped forward end wherein a first top-edge serves to lift the second needle butt into a half-height working position and a contiguous second top-edge serves to lift the second needle butt into a full-height working position;

b) a control tongue rockable by the first needle butts in the plane of the cam system is provided on the central longitudinal axis of the cam system within camming range of the first needle butts;

c) in a first group of cams, the cams are arranged symmetrically about the central longitudinal axis of the cam system and are moveable perpendicularly to the cam plane, wherein
   - two cams are located within camming range of the first needle butts near the control tongue or within camming range of the second needle butts and
   - two cams are located within camming range of the second needle butts near the needle sinkers.

In a flat bed knitting machine having such a cam and knitting system, a simple to construct and operationally reliable cam system for constant needle withdrawal (i.e., for forming stitches and loops of equal size), is realised.

Preferably the flat bed knitting machine according to the invention is also arranged such that d) the needle sinkers near the second needle butts each comprise two independently displaceable sections, of which
   - one section is arranged to engage those second needle butts in a half-height or a half-height and full-height working position and
   - the other section is arranged to engage those second needle butts in a full-height working position e) in a second group of cams, the cams are arranged symmetrically about the central longitudinal axis of the cam system and are moveable perpendicularly to the cam plane, wherein
   - two cams are located within camming range of the first needle butts,
   - two cams are located within camming range of the second needle butts and
   - two cams are located within camming range of the operating butts of the lifting jacks;

f) in a third group of cams, the cams are arranged symmetrically about the central longitudinal axis of the cam system, are moveable perpendicularly to the cam plane, and are located within camming range of the operating butts of the lifting jacks.

The flat bed knitting machine according to the invention provides the full range of weaving techniques, including transfer of stitches and forming stitches of different withdrawal depths, i.e., sizes, within a same row, by means of a very simply made needle bed and a very simple, compact and operationally reliable cam system.

Preferably the first group of cams is operated as a whole by the return motion of the carriage.

In a cam system which allows various needle withdrawals to be selected, the cams of the first, second and third groups of cams are all operated together by the return motion of the carriage.

Advantageously, the lifting jack at its forward end has a first inclined cam face followed by a half-height first lifting surface and a contiguous second inclined cam face followed by a full-height second lifting surface which extends up to the operating butt.

Preferably the cams of the first group located within camming range of the first needle butts or the second needle butts are needle-withdrawing cams, while the cams of the first group located within camming range of the second needle butts have an upper part for engaging with all the selected second needle butts and a lower part for engaging only with those selected second needle butts in their full-height position.

Advantageously, in each of the halves of the cam system arranged symmetrically to the central longitudinal axis there are two selection positions for the second needle butts wherein a first position serves for the selection of: stitch, long stitch, transfer stitch and a second position serves for the selection of: tuck-loop, short stitch, short tuck-loop, receive stitch and stitch.

For transferring and receiving stitches, the cams of the first group of cams moveable perpendicularly to the cam plane are activated.

For forming long and short stitches, the cam of the second group of cams moveable perpendicularly to the cam plane are activated.

For forming stitches and tuck-loops and slipping stitches in three-way-operation, the cams of the third group of cams moveable perpendicularly to the cam plane are activated.

For transferring and forming stitches, the cams of the first group, the cams of the second group and the cams of the third group of cams moveable perpendicularly to the cam plane are activated together with those cams of the first group which are within camming range of the second needle butts.

For transferring stitches and forming tuck-loops, the cams of the first group and the cams of the third group of cams moveable perpendicularly to the cam plane are activated together with those cams of the first group within camming range of the second needle butts.

Finally, the control tongue rockable in the cam plane is activated by the first needle butts of the needles selected for transferring stitches.

BRIEF DESCRIPTION OF THE DRAWINGS

A number of embodiments of the invention will now be described in more detail with reference to the drawings. In the drawings.

DETAILED DESCRIPTION OF THE INVENTION

Figure 1:
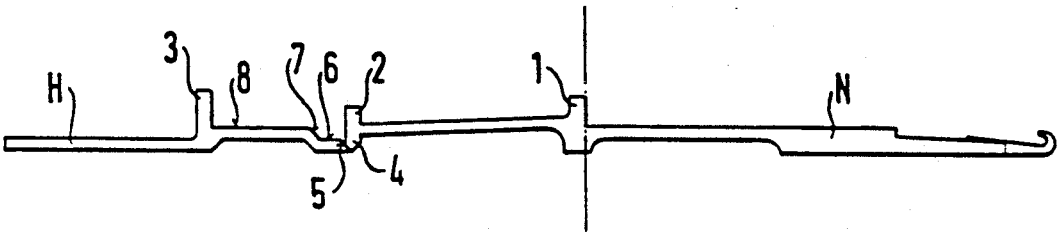
FIG. 1 shows a flexible shank needle and a rearwardly located double-lifting jack with the second needle butt sunk out of action in the needle-bed.
Figure 2:
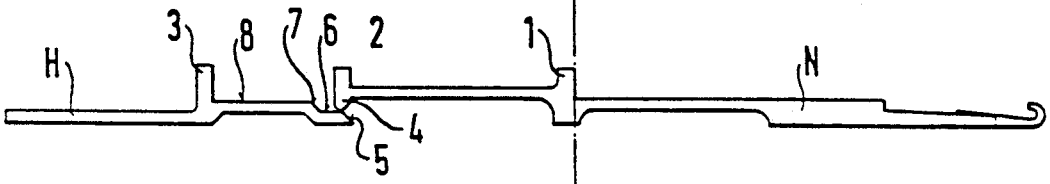
FIG. 2 is a similar view to FIG. 1 but with the second needle butt in the half-raised active position.
Figure 3:
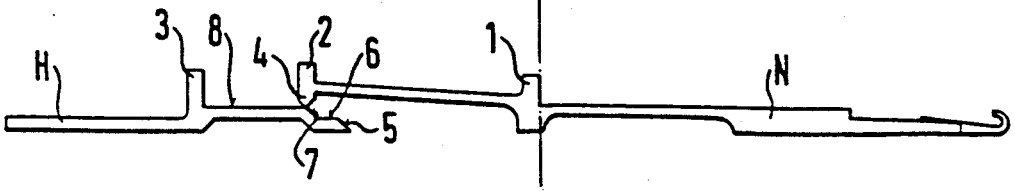
FIG. 3 is a similar view to FIG. 1 but with the second needle butt in the fully raised active position.

FIGS. 1 to 3 show a flexible shank needle N and a displaceable lifting jack H arranged one behind the other. The flexible shank needle N has a forward (anterior) butt 1 which always sticks out from the needle bed (not shown) and a rear (posterior) butt 2 which disappears into the needle bed due to the resilience of its shank. The lifting jack H has an operating butt 3 which always extends out of the needle bed so that it can be displaced.

A boss 4, formed under the second butt 2, is pressed onto the base of the needle channel by virtue of the shank's resilience as shown in FIG. 1. The second butt 2 thus remains sunk out of action in the needle bed.

The forward end of the lifting jack H has a first inclined cam face 5 which merges into a half-height first lifting surface 6 parallel to the base of the needle channel. A second inclined cam face 7 rises from the first lifting surface 6 up to a full-height second lifting surface 8 which is also parallel to the base of the needle channel and which extends to the operating butt 7 of the lifting jack H. When the needle and jack are relatively displaced from the position shown in FIG. 1, the boss 4 initially rides up the cam face 5 onto the first lifting surface 6 (FIG. 2). At this point, the needle butt 2 is in its half-height working position where it can be engaged by high contour but not intermediate contour cams of the cam system. If the needle and jack are now further displaced, the boss 4 rides up the cam face 7 onto the second lifting surface 8 (FIG. 3). In this position, the second needle butt extends fully from the needle bed into its full height working position where it can be engaged by each and every operative cam. Thus the second needle butt 2 can be lifted by the lifting jack up to two different levels and it has three possible positions:

inoperative (FIG. 1)
semi-operative (FIG. 2)
fully-operative (FIG. 3).

In the cam systems represented in FIGS. 4 to 13, fixed cams and operative cams which have been moved in a direction perpendicular to the cam plane are shown unhatched, inoperative cams and cams which are moveable perpendicularly to the cam plane are shown hatched, needle withdrawing cams and needle sinkers displaceable in the cam plane are marked with a double ended straight arrow and cams rotatable in the cam plane are marked with a double ended curved arrow. Furthermore the second needle butts located at different parts of the cam system are shown unhatched if they are sunk inoperatively in the needle bed, are marked with a cross if they are in their half-height semi-operative position and are shown in bold black if they are in their fully lifted operative position. The direction of movement of the carriage is indicated by an arrow S.

Various positions of the first needle butts 1, the second needle butts 2 and the operating butts 3 of the lifting jacks are shown in FIGS. 4 to 13. These are the positions occupied when knitting and are identified as follows:

Position 1: Basic position, needle butt 2 inoperative,
Position 2: position reached shortly after selection of: stitch, long stitch, or transfer stitch,
Position 3: second needle butt 2 in fully lifted operative position,
Positions 4 to 12: forming stitches or long stitches
Positions 13 to 15: forming stitches, long stitches or tuck-loops.
Position 16: end position,
Position 17: Basic position, needle butt 2 inoperative,
Position 18: position reached shortly after selection of: tuck-loops or short tuck-loops,
Positions 19 to 24: forming tuck-loops
Position 25: Basic position, needle butt 2 inoperative,
Position 26: position reached shortly after selection of: short stitch, or stitch,
Positions 27 to 32: forming short stitch
Positions 33 and 34: forming stitch or short tuck-loop
Positions 35 to 49: transferring stitch
Position 50: Basic position, needle butt 2 inoperative, Position 51: position reached shortly after selection of: transfer stitch Positions 52 to 59: receiving stitch.

Figure 4:
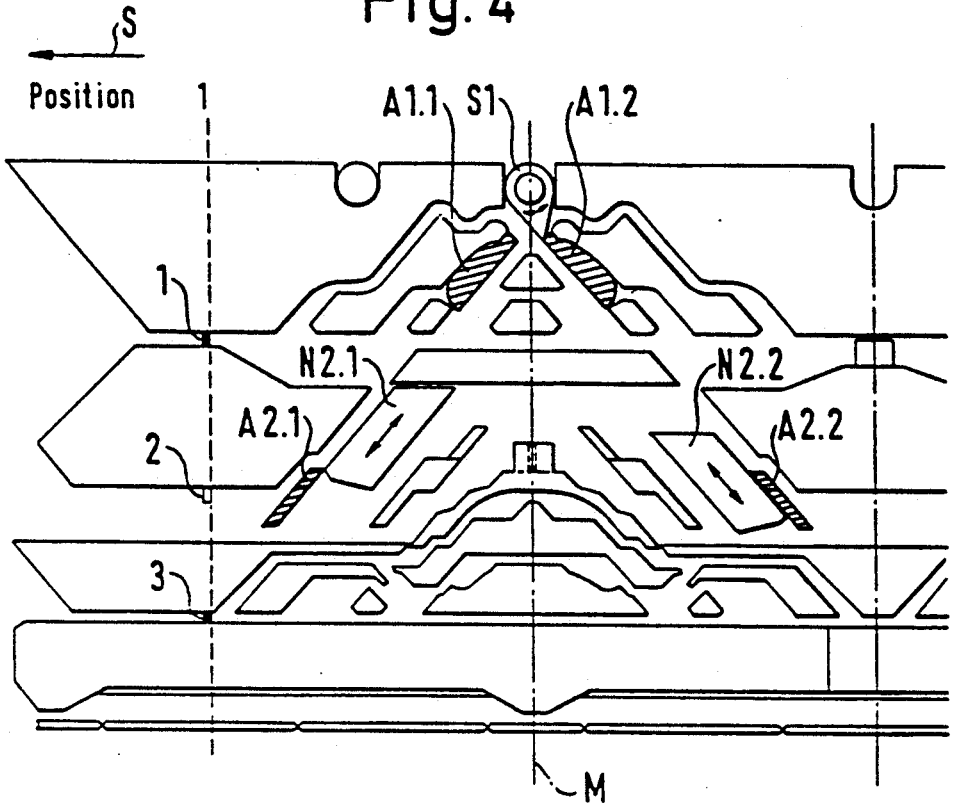
FIG. 4 shows a cam system for a fixed needle withdrawal.

FIG. 4 depicts a cam system for constant needle withdrawals with fixed cams that are shown unhatched. The cam system is essentially symmetrical about its central axis M and has two needle sinkers N2.1, N2.2, located in the neighbourhood of the second needle butts 2 and displaceable in the cam plane. A control tongue S1 rockable in the cam plane by the first needle butts 1 is located on the central longitudinal axis M of the cam system in the vicinity i.e. within camming range, of the first needle butts 1. A first group A of cams arranged symmetrically about the central longitudinal axis M of the cam system are moveable into and out of action in a direction perpendicular to the cam plane. This group consists of two cams A1.1 and A1.2 in the vicinity of the first needle butts near the control tongue S1 and two cams A2.1 and A2.2 in the vicinity of the second needle butts near the needle sinkers N2.1 and N2.2.

Figure 5:
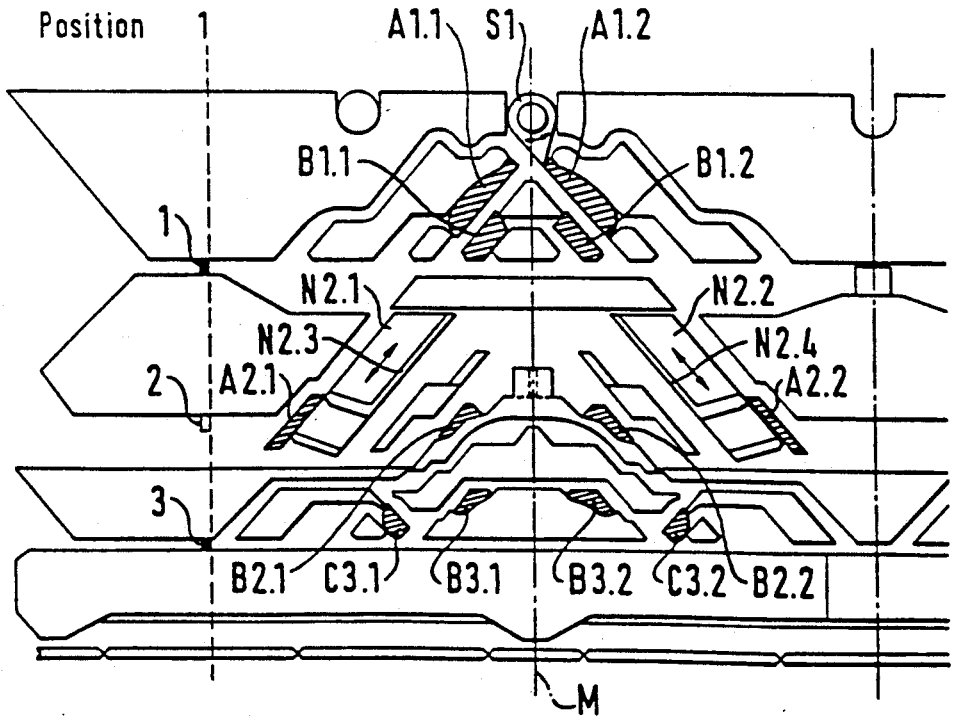
FIG. 5 shows a cam system for selectively variable needle withdrawals.

FIG. 5 shows a cam system wherein needle withdrawals can be selectively varied. Here a first pair of independently displaceable needle sinker sections N2.1, N2.2 are located in the neighbourhood of the second needle butts 2 for engaging the second butts 2 in their half- or their half- and full-height, working positions and a similar second pair of needle sinker sections N2.3, N2.4 are arranged for engaging the second needle butts 2 in their full-height working positions.

In addition, a second group B of cams arranged symmetrically about the central longitudinal axis of the cam system and moveable perpendicularly to the cam plane are provided. In this group B, two cams B1.1, B1.2 are located in the vicinity of the first needle butts 1, two cams B2.1, B2.1 in the vicinity of the second needle butts 2 and two cams B3.1, B3.2 in the vicinity of the operating butts 3 of the lifting jacks H.

Finally, there is provided a third group C of cams C3.1, C3.2 arranged symmetrically about the central longitudinal axis M of the cam system, moveable perpendicularly to the cam plane and located in the vicinity of the operating butts 3 of the lifting jacks H.

The first group A of cams, the second group B of cams and the third group C of cams are moved together, into and out of operation, by the return motion of the carriage.

The cams A1.1 and A1.2 of the first group A serve to control withdrawal of the needles. The cams A2.1, A2.2 of the first group A have an upper portion for engaging all of the selected second needle butts 2 and a lower portion for engaging only those second needle butts 2 which are in their fully-operative positions.

In each of the essentially symmetrical halves of the cam system, the flexible shank needles, or rather, their second needle butts 2, can be selectively placed into a first position which is used for stitches, long stitches and transfer stitches, or, into a second position which is used for tuck-loops, short stitches, short tuck-loops and for receiving stitches.

For transferring and receiving stitches, the cams of the first group A are moved perpendicularly to the cam plane into their operative positions. For forming long and short stitches, the cams of the second group B are moved perpendicularly to the cam plane into their operative positions. For forming stitches and tuck-loops during three-way-operation, the cams of the third group C are moved perpendicularly to the cam plane into their operative positions.

Figure 6:
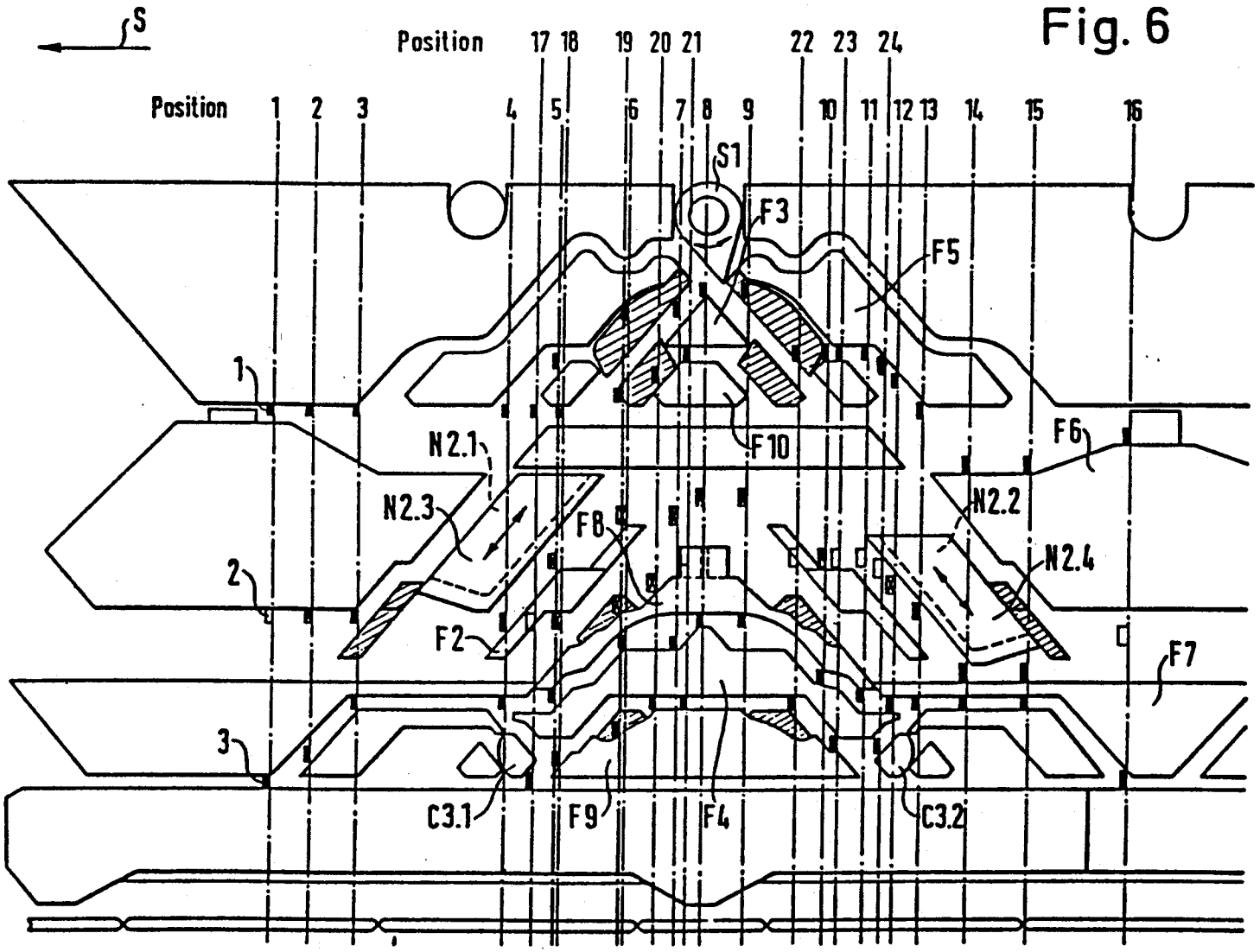
FIG. 6 shows the cam system of FIG. 5 adjusted for three-way operation for forming stitches and tuck-loops as well as for floating, i.e., slipping or not knitting stitches.

FIG. 6 depicts the needle and jack movements for selectively forming stitches and tuck-loops or for floating in three-way-operation using selectively variable needle withdrawal depths as per the cam system of FIG. 5. The first selectable position for cam movements from right to left is shown as position 1. The lifting jacks H, which are moved upwardly from position 1 to position 2 to reach this first selectable position, lift the second needle butts 2 into their semi-operative positions (indicated by a cross). The cams of the first group A are inoperative. By further movement of the carriage to the left, the lifting jacks H are driven-out to position 3. Consequently the needle butts 2 are lifted into their fully-operative positions. In position 4, the operative second needle butts 2 are driven-out by a fixed cam F2 into position 5. As the lifting jacks remain in position, the second needle butts 2 slide into their semi-operative positions (FIG. 2). From this position, they are driven by cam F2 into position 6. Here the first needle butts 1 are engaged by a fixed cam F3 and then brought into the stitch-clearing position 8.

In order to hold the second needle butts in their semi-operative positions, the lifting jacks must be driven-out. This is done by a fixed cam F4. From position 9, the flexible shank needles N begin their downwards movement. The first needle butts 1 are engaged by a fixed cam F5 and moved from position 9 to position 13. From this position, the flexible shank needles are drawn into the starting position required for stitch formation by means of the needle sinker N2.4 acting on the second needle butts 2. From position 15 onwards the flexible shank needles are driven-out by a fixed cam F6 acting on the first needle butts 1, into the comb-like position 16 which is similar to the starting position. The lifting jacks H move in a downward direction from position 9 onwards. In this way, the second needle butts are placed out of action in position 11, in the semi-operative state in position 12 and in the fully-operative state from position 13 onwards. In going from position 15 to position 16, the lifting jacks H are drawn-back by a fixed cam F7 into the basic position in which the second needle butts 2 are out of action.

If tuck-loops are to be formed in the same row with the same cam as in FIG. 6, then the flexible shank needles N which will be used for the even tuck-loops must be placed in their second selectable position, namely, position 18. The second needle butts 2 which were still inoperative in position 17 are brought into the semi-operative position, position 18, by the selected lifting jacks. The second needle butts 2, which were not selected in the first selectable position, position 2, slide through under the cam F2. The cams in group B are inactive. The semi-operative second needle butts 2 are engaged by a fixed cam F8 and driven-out from position 19 to position 20. In order to retain the second needle butts 2 semi-operative in position 20, the lifting jacks H are driven-out by another fixed cam F9. From position 20, the flexible shank needles N are driven-out via their first butts 1 to the receive position and, by a fixed cam F10, to the tuck position, position 21. The lifting jacks H are withdrawn from position 22 to position 23 in order then to be driven-out again by the active cam C3.2 into position 13. During this time, the second needle butts 2 move from the semi-operative to the inoperative position and then back to the active position 13 in order to be moved from there together with the stitch-forming flexible shank needles N to position 16.

Figure 7:
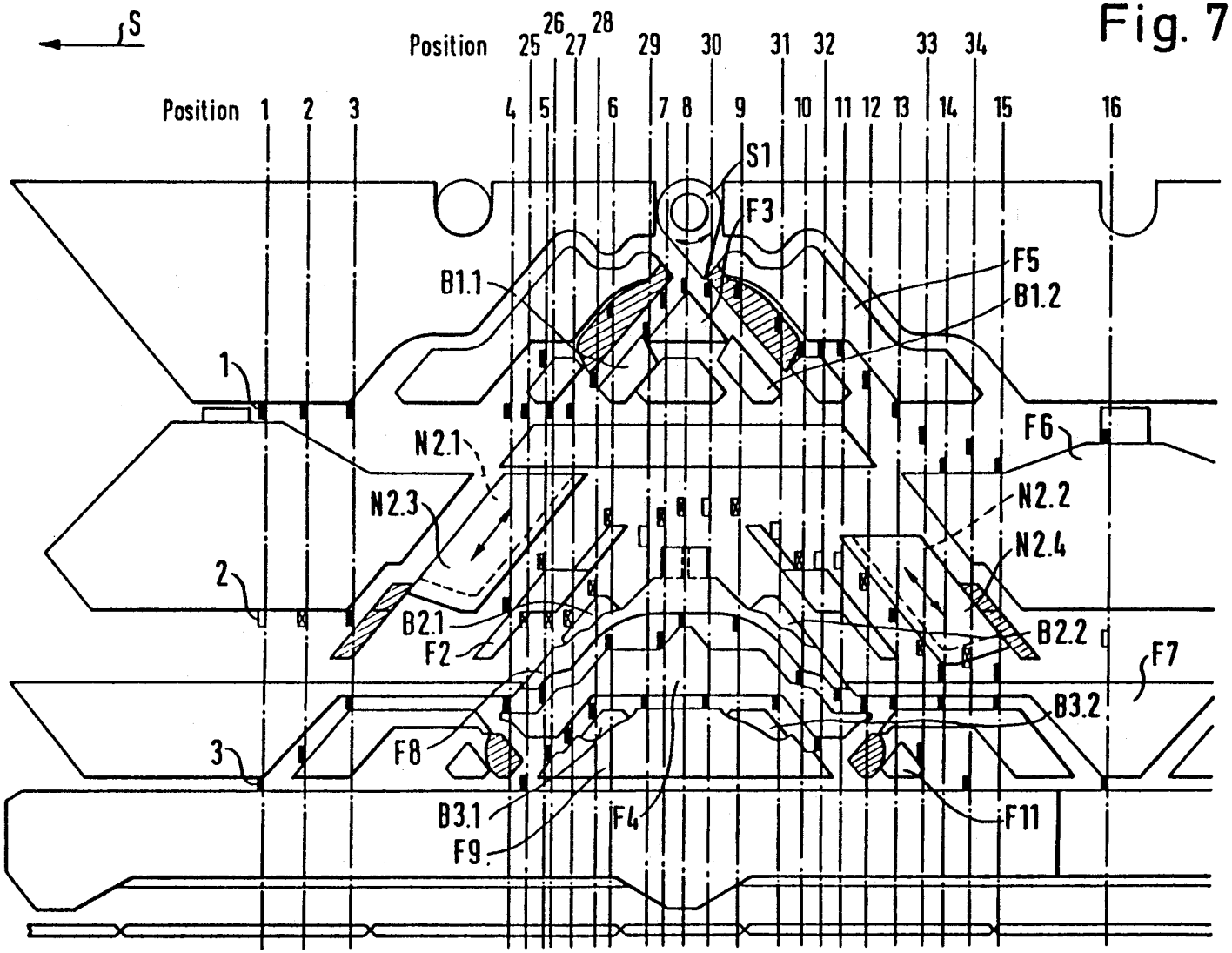
FIG. 7 shows the cam system of FIG. 5 arranged to produce long and short stitches.

FIG. 7 serves to explain the formation of long and short stitches within a knitting row. The formation of long stitches has already been described with reference to FIG. 6. The formation of short stitches commences at the second selectable position, position 26. The cams of groups A and C are inoperative while those of group B are operative. The displaceable needle sinkers N2.1, N2.3 and N2.2, N2.4 each comprise sections at two different levels, namely N2.1 and N2.3, and N2.2 and N2.4 respectively, which are driven into their withdrawal positions in different manners. The needle sinker N2.2 (shown in dashed line) engages the semi-operative second needle butts 2, while the needle sinker N2.4 engages the fully operative ones. The flexible shank needles N, which will be knitting short stitches, were selected in position 26 as described above. The second needle butts are semi-operative and are engaged by cam B2.1 and driven into position 28. In order to retain these needle butts 2 in their semi-operative positions, the lifting jacks are simultaneously driven out by cams F9 and B3.1. From position 28, the flexible shank needles N are brought into the stitch clearing position 8 by the interaction of needle butts 1 and cams B1.1 and F3, and, then from there into the comb-like position, position 13. In positions 30, 31 and 32, the second needle butts 2 of the flexible shank needles N, which will be forming short stitches, are inoperative since the lifting jacks H are withdrawn by cam F4 as indicated at position 32. While the working butts 3 of the lifting jacks H slide over a fixed cam F11, the second needle butts 2 are brought once more to their half-height position, as shown in position 33, so that they can be engaged by needle sinker N2.2 and drawn-down a little further into position 34.

The lifting jacks are moved by the flexible shank needles N into their basic position, position 34.

Figure 8:
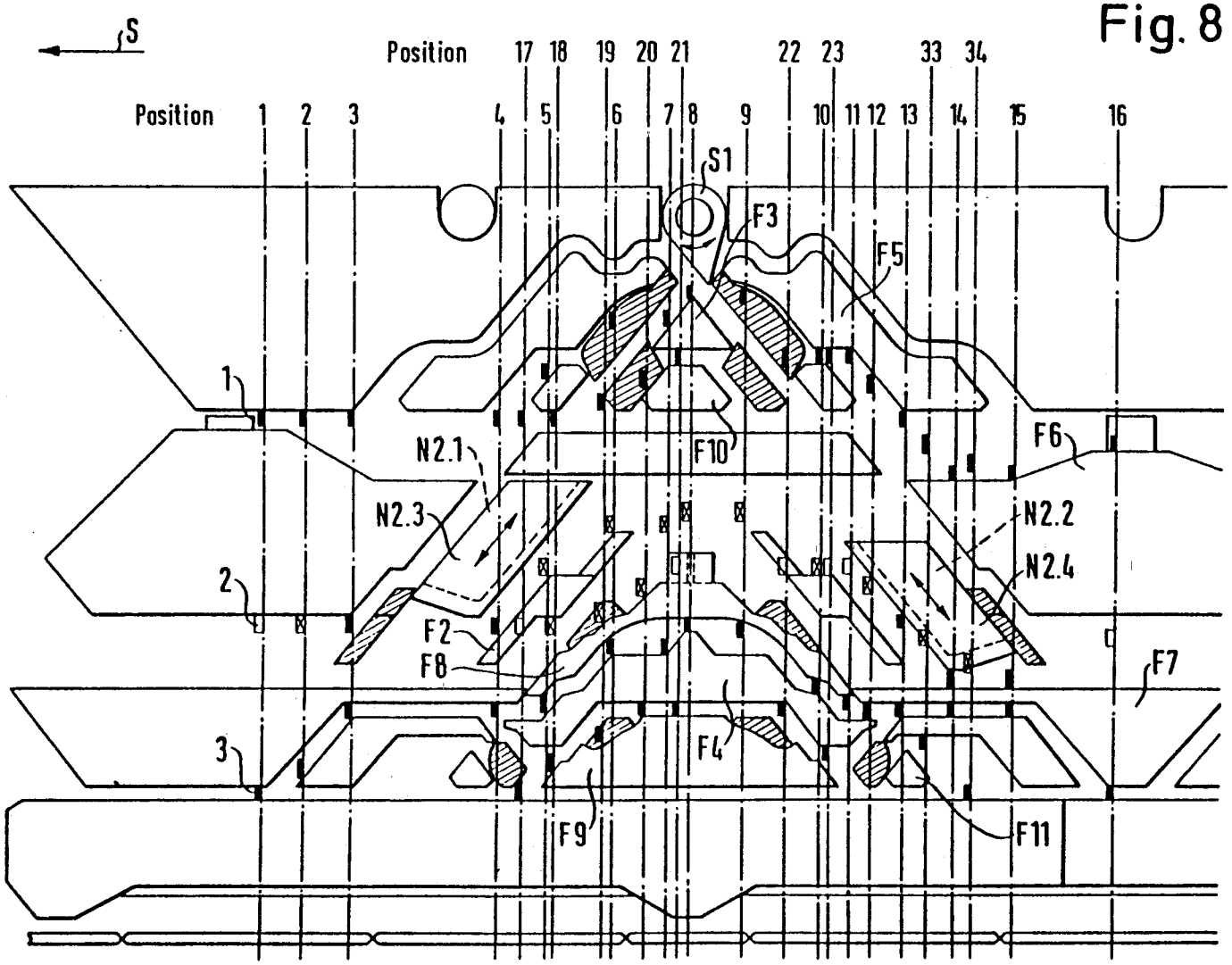
FIG. 8 shows the cam system of FIG. 5 arranged to produce long stitches and short tuck-loops.

The movements of the flexible shaft needles N and lifting jacks H for long stitches and short tuck-loops are shown in FIG. 8. The movements are similar to those described with respect to FIG. 6 except that the cams of group C are inoperative. The needle movements correspond to those of FIG. 6 and those of the lifting jacks to FIG. 7.

Figure 9:
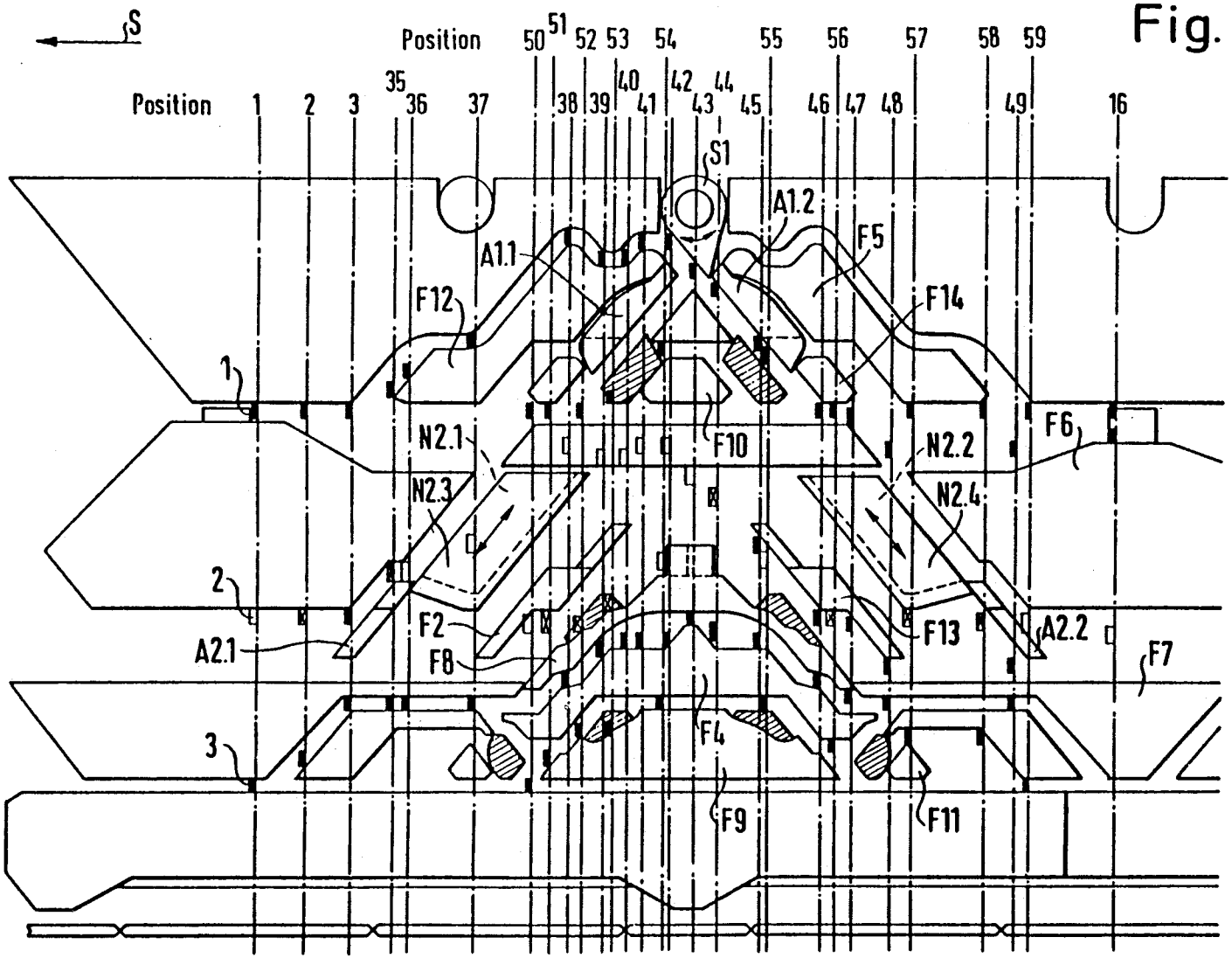
FIG. 9 shows the cam system of FIG. 5 arranged to transfer and receive stitches.

A further needle and lifting jack cam-movement is necessary for transferring and receiving stitches, as shown in FIG. 9.

For transferring stitches, the first selectable position, position 2 is used. The cams of group A are operative and those of groups B and C are inoperative. Up to position 3, the process is the same as for forming stitches. As the cam section A2.1 is operative, those second needle butts 2 in the fully-operative position are engaged and moved to position 35. The lifting jacks H, which are not transported upwards therewith, permit the second needle butts 2 to slide into a half-raised position. From there a fixed cam F12 controls the further movement of the flexible shank needles N. The first needle butts 1 take the flexible shank needles 2 to position 36 in which the second needle butts 2 are fully sunk into the needle bed (FIG. 1). The flexible shank needles N are driven out by cam F12 to the transfer position, positions 38, 39, 40 and 41. From position 42, the flexible shank needles are moved by the cam frog or control tongue S1 and the cam A1.2 via position 44, where the needle butts 2 are half raised, to position 45, where the needle butts 2 are fully operative and then by means of fixed cam F13 via positions 46 and 47 to position 48. In position 16, the flexible shank needles and lifting jacks are once more in their basic positions.

For receiving stitches, the second selectable position, position 51 is used. In this position the second needle butts 2 are semi-operative. The further operation is the same as for forming tuck-loops. Needle withdrawal, which is initiated at position 15 through the co-operation of cam A1.2 and the first needle butts 1 is continued by cam F14. At position 56, the second needle butts 2 are semi-operative.

As the cams F13 and F2 as well as A2.2 and A2.1 under the horizontal line are only at half height, the second needle butts 2 slide through under the cam F13 and remain in their comb-like position. The lifting jacks H operate in the same way as described with reference to FIGS. 7 and 8 with the exception that withdrawal into the basic position is reached at position 59.

FIG. 9 shows a further variant of the cams A1.1 and A2.1, wherein these cams end at the dashed line. In this embodiment, at position 55, the receiving flexible shaft needles remain in the receiving position underneath the cam A1.2 and are only later brought into the comb-like position by the fixed cam F5.

FIGS. 10 to 13 show cam systems which differ from those shown in FIGS. 5 to 9 in that the cams A1.1 and A1.2 of the first group A of cams are arranged in the vicinity of the second needle butts 2 rather than the first needle butts 1 and in that the relative sizes of the cams are somewhat different. This provides additional combinations of needle movements.

Figure 10:
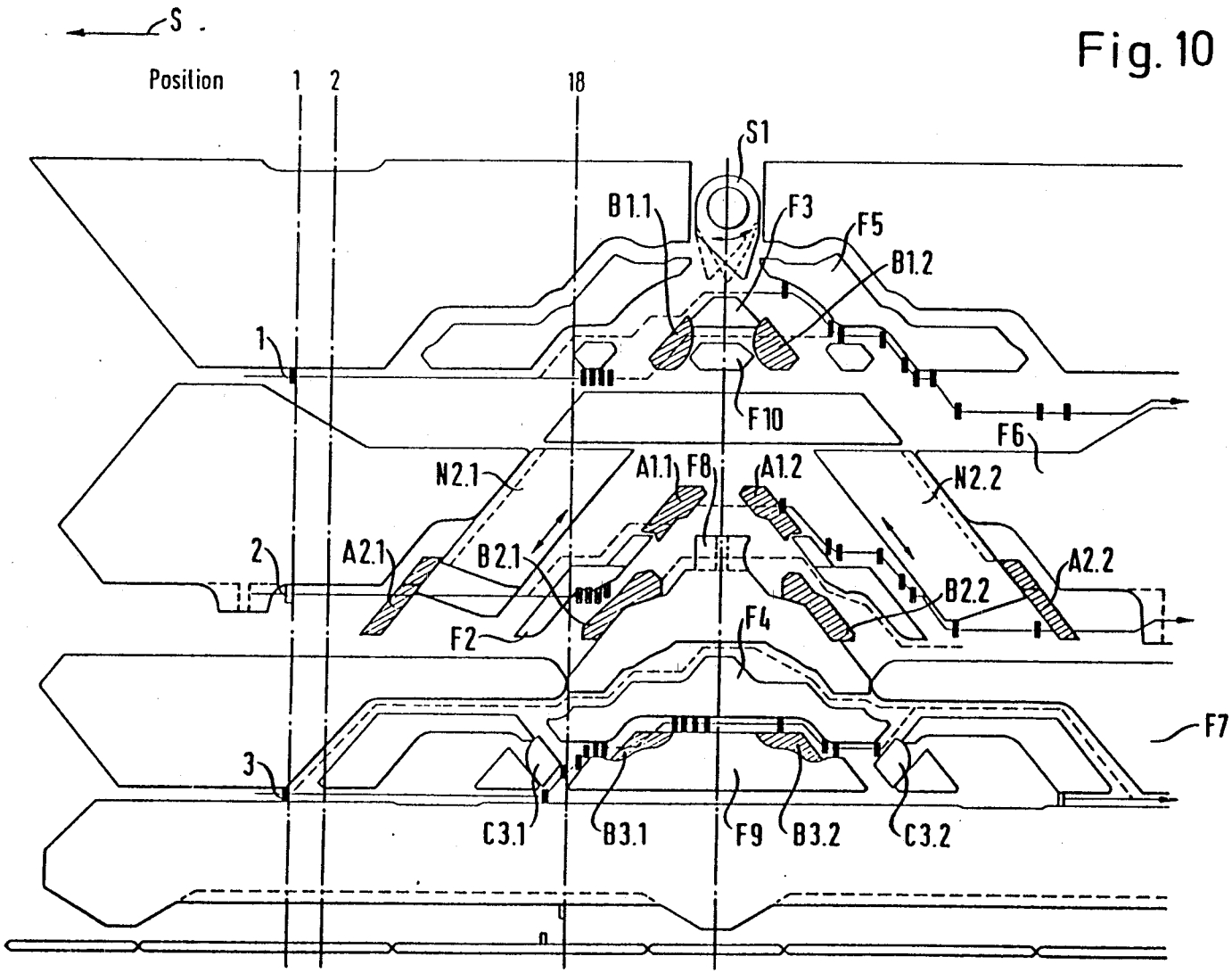
FIG. 10 shows a modification of the cam system of FIG. 5 adjusted for three-way operation for forming stitches and tuck-loops as well as floating.

In FIG. 10, the cams of groups A and B are inoperative while those of group C are operative. Thus, during three-way-operation it is possible to select between forming stitches and tuck-loops or clearing, as was described in connection with FIG. 6.

Figure 11:
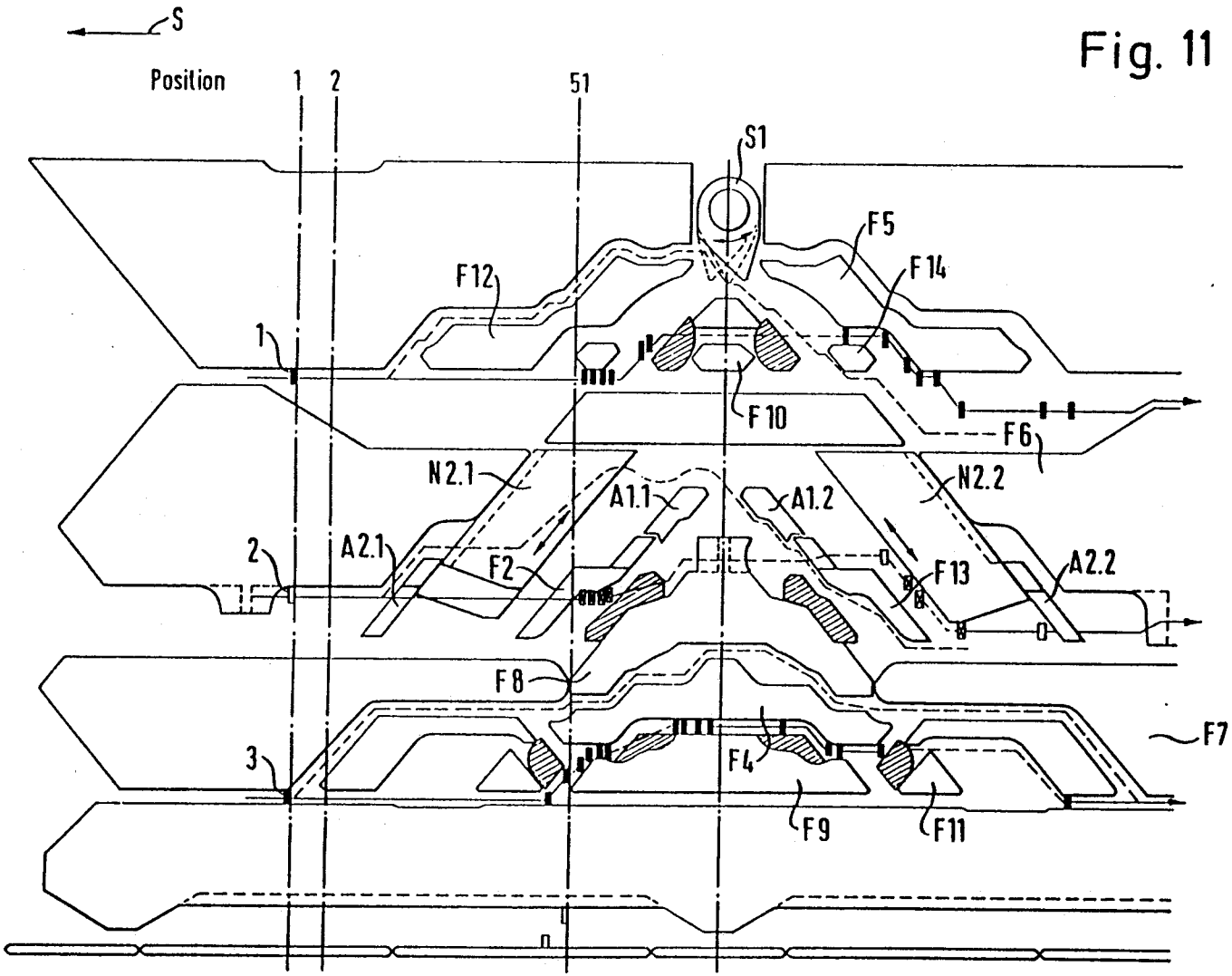
FIG. 11 shows the cam system of FIG. 10 arranged to transfer and to receive stitches.

In FIG. 11, the cams of group A are operative while those of groups B and C are inoperative. This permits stitches to be transferred and received as was described with reference to FIG. 9. The transferring needles are drawn-down via their first needle butts 1 by the control tongue S1 and then the second needle butts 2, which have thus been activated are drawn-down by the cam A1.2.

Figure 12:
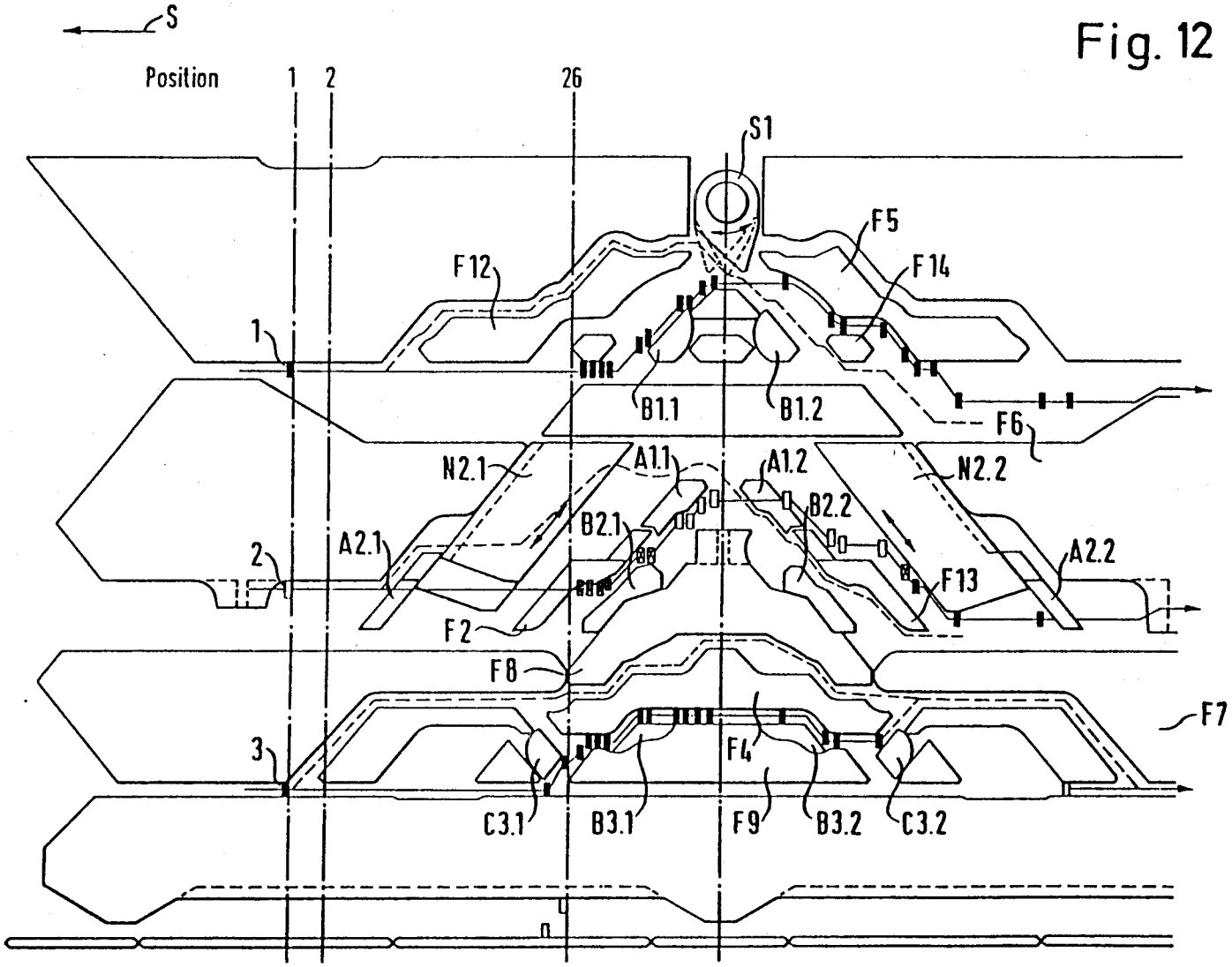
FIG. 12 shows the cam system of FIG. 10 arranged to transfer and to form stitches.

In FIG. 12, the cams of groups A, B and C are all operative. Thus in the first selectable position, position 2, the selected needles can transfer stitches and in the second selectable position, position 26, the selected needles can form stitches.

Figure 13:
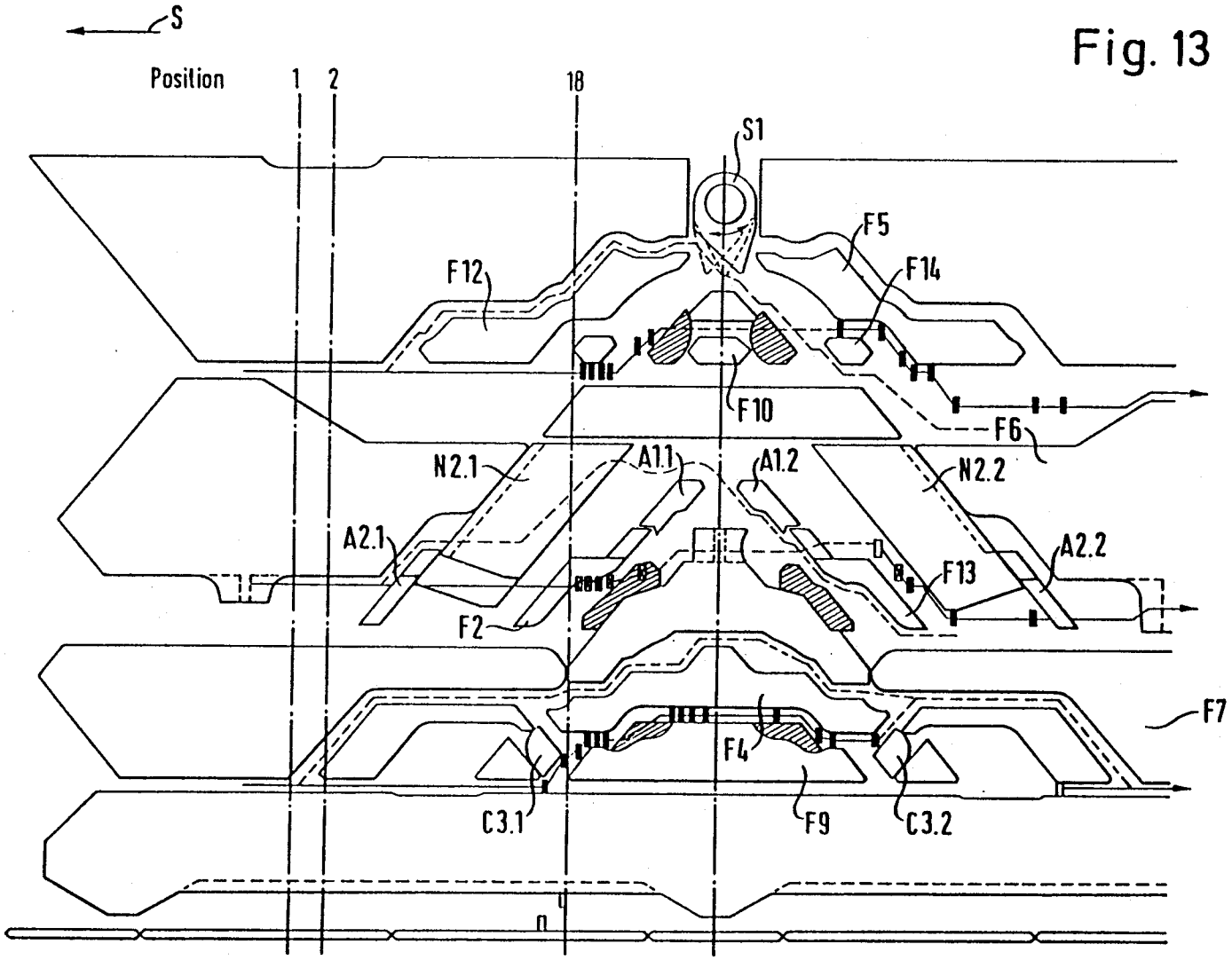
FIG. 13 shows the cam system of FIG. 10 arranged to transfer stitches and to form tuck-loops.

In FIG. 13, the cams of groups A and C are operative while those of group B are inoperative. Thus in the first selectable position, position 2, the selected needles can transfer stitches, and in the second selectable position, position 18, the selected needles can form tuck-loops. By means of the operative cam C3.2, the second needle butts 2 of the tuck-loop-forming needles can be brought into operation again so that they can be engaged by the needle sinker N2.2 and the needles thus moved to the desired withdrawal depth.

I claim:

1. A flat bed knitting machine, comprising: knitting needles arranged in needle channels of a needle bed, each of said knitting needles comprising a flexible shank, an anterior first needle butt projecting from the needle bed, and a posterior second needle butt which sinks into the needle bed;

displacing jacks located behind the knitting needles, each of said displacing jacks comprising an operating butt and a forward end, wherein said forward end has a first lifting surface for lifting the posterior second needle butt into a half-height working position and a contiguous second lifting surface for lifting the posterior second needle butt into a full-height working position; and a cam system arranged symmetrically about a central axis in a cam plane, said cam system comprising at least two needle sinkers displaceable in the cam plane for engaging the posterior second needle butts, a control tongue located on the central axis within camming range of the anterior first needle butts and rockable by the anterior first needle butts, and a first group of cams arranged symmetrically about the central axis and moveable perpendicularly to the cam plane, said first group of cams comprising at least two first cams within camming range of the anterior first needle butts near the control tongue or within camming range of the posterior second needle butts and at least two second cams within camming range of the posterior second needle butts near the needle sinkers.

2. A flat bed knitting machine according to claim 1, further comprising:

a second group of cams arranged symmetrically about the central axis and moveable perpendicularly to the cam plane, wherein said second group of cams comprises two third cams located within camming range of the anterior first needle butts, two fourth cams located within camming range of the posterior second needle butts, and two fifth cams located within camming range of the operating butts of the displacing jacks; and a third group of cams arranged symmetrically about the central axis and moveable perpendicularly to the cam plane, wherein said third group of cams comprises at least two sixth cams located within camming range of the operating butts of the displacing jacks; and wherein each of the needle sinkers comprises two independently moveable sections, wherein a first moveable section is arranged to engage either the first lifting surface or the second lifting surface and a second moveable section is arranged to engage the second lifting surface.

3. A flat bed knitting machine according to claim 1, further comprising a carriage movably coupled to the needle bed, wherein the first group of cams is operated by return movement of the carriage.

4. A flat bed knitting machine according to claim 2, further comprising a carriage movably coupled to the needle bed, wherein the first group of cams, the second group of cams and the third group of cams are operated together by return movement of the carriage.

5. A flat bed knitting machine according to claim 1, wherein the forward end of the displacing jack comprises a first inclined cam face followed by the first lifting surface and a contiguous second inclined cam face followed by the second lifting surface, wherein said second lifting surface extends to the operating butt.

6. A flat bed knitting machine according to claim 5, further comprising a lifting boss located under the posterior second needle butt, wherein said lifting boss has a basic position in which it lies on a floor of the needle channel and two lifted positions which it reaches by flexibly sliding up onto the first and second lifting surfaces.

7. A flat bed knitting machine according to claim 1, wherein the cams of the first group within camming range of the posterior second needle butts have an upper part for engaging with all the selected posterior second needle butts and a lower part for engaging only with those selected posterior second needle butts in their full-height position.

8. A flat bed knitting machine according to claim 1, wherein the cam system has two halves arranged symmetrically about the central longitudinal axis, each half having two selection positions for the posterior second needle butts wherein a first position serves for the selection of stitch, long stitch, and transfer stitch, and a second position serves for the selection of tuck-loop, short stitch, short tuckloop, receive stitch and stitch.

9. A flat bed knitting machine according to claim 8, wherein the first group of cams are activated in order to select transfer and receive stitches.

10. A flat bed knitting machine according to claim 8, wherein the second group of cams are activated in order to select long and short stitches.

11. A flat bed knitting machine according to claim 8, wherein the third group of cams are activated in order to select stitch, tuck-loop, and slip stitches.

12. A flat bed knitting machine according to claim 8, wherein the first group of cams, the second group of cams, and the third group of cams are activated with those cams of the first group within camming range of the second needle butts in order to select transfer and forming stitches.

13. A flat bed knitting machine according to claim 8, wherein the first group of cams and the third group of cams are activated with those cams of the first group within camming range of the second needle butts in order to select transfer and tuck-loop stitches.

14. A flat bed knitting machine according to claim 8, wherein the control tongue is activated by the first needle butts of the needles selected for transferring stitches.

* * * * *